US005521002A

United States Patent [19]

Sneed

[11] Patent Number: 5,521,002

[45] Date of Patent: May 28, 1996

[54] MATTE TYPE INK JET FILM

[75] Inventor: Michael C. Sneed, Emerson, Ga.

[73] Assignee: Kimoto Tech Inc., Cedartown, Ga.

[21] Appl. No.: 183,025

[22] Filed: Jan. 18, 1994

[51] Int. Cl.[6] ..... B05D 5/04

[52] U.S. Cl. ..... 428/331; 428/195; 428/206; 428/500; 428/520

[58] Field of Search ..... 428/206, 207, 428/211, 331, 409, 195, 500, 520, 323, 480, 447, 412, 481, 483

[56] References Cited

U.S. PATENT DOCUMENTS

| | | | |
|---|---|---|---|
| 3,870,549 | 3/1975 | Ruygrok | 117/73 |
| 4,446,174 | 5/1984 | Maekawa et al. | 428/207 |
| 4,460,637 | 7/1984 | Miyamoto et al. | 428/212 |
| 4,474,850 | 10/1984 | Burwasser | 428/195 |
| 4,478,910 | 10/1984 | Oshima et al. | 428/206 |
| 4,481,244 | 11/1984 | Haruta et al. | 428/211 |
| 4,528,242 | 7/1985 | Burwasser | 428/413 |
| 4,555,437 | 11/1985 | Tanck | 428/212 |
| 4,592,954 | 6/1986 | Malhotra | 428/335 |
| 4,680,235 | 7/1987 | Murakami et al. | 428/500 |
| 4,686,118 | 8/1987 | Arai et al. | 428/336 |
| 4,713,280 | 12/1987 | Williams | 428/195 |
| 4,722,868 | 2/1988 | Pope | 428/480 |
| 4,732,786 | 3/1988 | Patterson et al. | 427/261 |
| 4,770,934 | 9/1988 | Yamasaki et al. | 428/195 |
| 4,775,594 | 10/1988 | Desjarlais | 428/480 |
| 4,781,985 | 11/1988 | Desjarlais | 428/421 |
| 4,868,581 | 9/1989 | Mouri et al. | 428/195 |
| 4,877,680 | 10/1989 | Sakaki et al. | 428/332 |
| 4,879,166 | 11/1989 | Misuda et al. | 428/212 |
| 4,892,775 | 1/1990 | Song | 428/195 |
| 4,902,577 | 2/1990 | Butters et al. | 428/483 |
| 4,956,223 | 9/1990 | Arai et al. | 428/212 |
| 4,956,230 | 9/1990 | Edwards et al. | 428/341 |
| 4,997,697 | 3/1991 | Malhotra | 428/195 |
| 5,002,825 | 3/1991 | Mimura et al. | 428/315.5 |
| 5,006,407 | 4/1991 | Malhotra | 428/336 |
| 5,023,129 | 6/1991 | Morganti et al. | 428/195 |
| 5,068,140 | 11/1991 | Malhotra et al. | 428/216 |
| 5,075,153 | 12/1991 | Malhotra | 428/207 |
| 5,102,717 | 4/1992 | Butters et al. | 428/195 |
| 5,118,570 | 6/1992 | Malhotra | 428/195 |
| 5,137,773 | 8/1992 | Malhotra | 428/215 |
| 5,190,805 | 3/1993 | Atherton et al. | 428/195 |
| 5,202,205 | 4/1993 | Malhota | 428/330 |
| 5,206,071 | 4/1993 | Atherton et al. | 428/195 |
| 5,212,008 | 4/1993 | Malhotra et al. | 428/216 |
| 5,223,338 | 6/1993 | Malhotra | 428/342 |

*Primary Examiner*—Pamela R. Schwartz
*Attorney, Agent, or Firm*—Jones & Askew

[57] ABSTRACT

Disclosed is a ink receiving matte coating composition and ink receiving media ink jet printing which comprises a transparent, translucent, or opaque base support, such as polyester film, on to which a matte, opaque ink receptive layer is applied on at least one side. The ink receptive matte coating composition of the present invention is comprised of one or more hydrophilic, water soluble polymers, a hydrophobic cellulose ether polymer, a polyalkylene glycol, and a filler, or filler/pigment combination, for making the layer opaque. The ink receiving media described herein allows for quick drying of ink jet printing inks while controlling the edge sharpness of the printed areas and is resistant to moisture and humidity effects, such as fingerprinting, slowed ink drying times, and easy removal of the coated ink receptive layer with moisture, thus increasing its value as an archivable storage media for ink jet printed images.

8 Claims, No Drawings

MATTE TYPE INK JET FILM

TECHNICAL FIELD

This invention relates to a novel ink receiving composition and print recording media, and a method of making thereof, comprising a transparent, translucent, or opaque base support with a matte, opaque ink receptive coating to be used for receiving ink jet printed images and designs, that possesses long term archivable properties for such images and designs.

BACKGROUND OF THE INVENTION

In recent years, ink jet printing technology has expanded from industrial labeling applications to office printing. These type of printers are low cost, near laser printing quality, low noise and maintenance, and have print speeds upwards of ten pages per minute for office applications. Another advantage of the use of ink jet printers is the development of consistent, high-quality color printing capabilities for the full range of colors. These attributes have made the ink jet printer one of the most popular office printers on the market today. More recently, ink jet printing technology has expanded into the reprographic market with the advent of large format ink jet plotters, such as the Hewlett Packard Designjet series and Encad's Novajet series. Generally, such plotters can produce a range of sizes of drawings and designs from the standard A size (8.5"×11") up to an E size (36"×48") plot. One example of the use of such ink jet plotters is the production of designs, floor plans, and structures by way of computer aided design (CAD) software. Architects and engineers are increasingly employing such CAD software for "drawing", thereby negating the need for the more conventional hand drafting techniques.

Ink jet printing technology is a form of printing that encompasses the projection of ink through a nozzle orifice, forming tiny droplets of a specific diameter, directly onto a substrate, such as paper or film, to form written symbols and drawn images. The ink jet printer receives electronic information, usually from application software via a computer, and converts the electronic information into legible hard copies. Several different technologies are used for such projection of ink droplets onto a substrate. For example, one technology utilizes a continuous stream of ink droplets being discharged from an ink reservoir through a nozzle. The droplets may then be deflected by means of an electrically charged field to the substrate. Those droplets not deflected to the substrate by the electrically charged field are allowed to flow in a straight stream and are collected and recirculated for reuse. Another example of ink jet printing technology is the use of heating elements for the direct stimulation of individual ink droplets. In this method of printing, the ink may be thermally excited by the heating element contact which causes the ink to be forced through the nozzle orifice and projected onto the substrate.

Ink compositions used in ink jet printing are carefully chosen by the manufacturer depending upon the technology used in the printer. Inks are usually manufactured to high quality standards to control the viscosity, particulate size, conductivity, surface tension, foaming, biological and chemical activity, lightfastness, and drying times. The inks must not be allowed to dry inside of the reservoir or in the nozzles of the printhead. To circumvent this problem, two types of ink jet inks have been developed: high boiling organic solvent and water combinations, and those that are essentially aqueous based. These solvent systems are vehicles for the ink dyes. In addition to the purified dyes, the inks may contain additives such as surface tension modifiers, pH buffers, defoamers, and fungicides, to make the ink acceptable for ink jet printing.

The use of aqueous and aqueous/high boiling organic solvent vehicles in ink jet printing creates the greatest challenge for the design of the media on which to print. These ink vehicles have slow evaporation rates to avoid drying or clogging of the inks in the nozzle or reservoir of the printer. However, the slow evaporation rate also impedes the drying of the ink on the surface of the substrate to which it is applied. Therefore, the inks can be smeared or rubbed off before they are completely dry. Also, low surface tensions of some inks can increase the lateral diffusion, or spreading, of the ink causing the images to be blurred. Control of the drying and absorption of the inks onto the surface of the recording media are of primary concern to the media design.

Great care must be taken in the design of recording media, whether paper, vellum, transparent or matted film, to provide a suitable means for recording ink jet printed symbols and images. In many cases, the base support used is inherently hydrophobic and thus repels the aqueous or aqueous/high boiling organic solvent based inks. Also, due to its hydrophobicity, the surface tension of the film is usually very high, therefore causing the inks to "bead" with a concomitant loss of edge acuity of the printed symbols and images. Due to these immediate problems, ink receiving media are often prepared by treating the surface of the base film with chemical coatings to alleviate the above mentioned problems.

In the art of producing matted, opaque coated films to be used as a printing substrate in ink jet printers or plotters, water soluble, hydrophilic natural and synthetic polymers may be used in combination with fillers, to provide the desired matte surface and opaque appearance to the film. Control of the lateral diffusion, or spreading, of the applied inks to matte type ink jet films and highly filled papers, however, is especially difficult. Forces such as capillary action, wettability of the filler, and surface tension of the ink used in the printing process contribute to the lateral spreading of the inks. Some amount of spreading is necessary to cause the blending of individual ink dots to give a more solid, uniform image appearance. However, excessive spreading leads to loss of image sharpness. Other desirable characteristics in a matte type ink receiving media include, enhanced image density, favorable visible and U.V. densities, anti-curling, long term stability of the printed image and of the media, high resistance to moisture degradation, and rapid drying times and resistance to smudging and fingerprinting. Yet another desirable characteristic in an ink receiving matte media is an optimal balance between hardness and porosity. Hardness is important for permitting pen or pencil writing, e.g. hand annotation of a printed image. If a coating is not sufficiently hard the pressure of such writing will damage the media, crushing or crumbling the coating layer and leaving impressions. However, hardness generally is inversely related to porosity, which is important for ink receiving and drying time attributes of the media.

A variety of matte ink receiving media have been developed. For example, U.S. Pat. No. 4,680,235 (Murakami et al.) describes the use of surface active agents in a surface recording layer which do not form a material insoluble in the ink composition in combination with a dye contained in the ink composition. The '235 patent further describes the use of white pigments, such as barium sulfate, calcium carbonate, silica, zinc oxide, titanium dioxide, and others, in combination with a binder and the surface active agent to create an opaque recording material for ink jet printers. U.S. Pat. No. 5,206,071 (Atherton et al.) discloses ink jet printing film media that comprise a transparent, translucent or opaque substrate having on at least one side thereof a water-insoluble, water-absorptive and ink-receptive matrix comprised of a hydrogel complex and a polymeric high molecular weight quaternary ammonium salt. The matrix may contain pigments and fillers to provide annotatability, rapid drying, image density and actinic transmissiveness. The matrix may also contain white pigments, such as titanium dioxide, to improve the image contrast to the matte films. Another example of matte ink jet film can be found in U.S. Pat. No. 4,732,786 (Patterson et al.), which discloses a coated ink jet printing substrate where the coating utilizes an insolubilized hydrophilic polymer. The coating contains a) from 0 to 90 parts by weight of pigment, b) from 0 to 95 parts by weight of binder, c) from 1 to 100 parts by weight of an insolubilized hydrophilic polymer, and d) from 0.1 to about 50 milliequivalents per gram of polymer of a polyvalent cation selected from metallic salts, complexes and partially alkylated metal compounds having a valence greater than one and a coordination number greater than two. Another example is disclosed in U.S. Pat. No. 5,023,129 (Morganti et al.) as an element useful for recording images using nonimpact type printing with a transparent support having an antistatic layer coated on one side and a print receptive layer coated on the other, or the print receptive layer may be coated over the antistatic layer. The print receptive layer is a combination of binder, crosslinking agent, whitener, and matte agent such as silica, rice starch, and methacrylate beads.

Notwithstanding these various matte ink receiving media, there remains a need for improved recording material with matte, opaque surfaces for receiving ink jet printed inks to produce high quality images with improved edge acuity, image enhancement, and an optimum balance between hardness and porosity. Additionally there is a need for an ink receiving media that has excellent archivability characteristics, resistance to fingerprinting and curling, and provides good reproducibility using conventional methods such as diazo reproductions and electrophotographic processes. Also, there is a need to improve over the prior art such properties as drying time of the printed inks, desirable visible density and U.V. density of the printed image, and moisture resistance of the coating.

SUMMARY OF THE INVENTION

An object of this invention is to provide a composition and a matte ink receiving media for ink jet printed inks that produces high quality, archivable images. Another object of the invention is to provide a method of making such an ink receiving media, and a method for printing using the ink receiving media. Another object of the present invention is to provide a matte recording media that provides superior image sharpness, ink drying times, and image density, thus providing a suitable means to be used as a "master" image for reproductive processes, such as diazo reproductions and electrophotographic machines. A further object of the invention is to provide a matte type ink receiving media that resists curling without the need to apply a separate anti-curl coating to the base support material. Also, an object of the present invention is to provide a means for an environmentally stable media for archivable storage of "master" prints and images by the use of a thermally stable, humidity and tear resistant, non-yellowing substrate, such as polyester, onto which a composition is applied to act as the ink receptive coating, the coating also being designed to provide archivability by being non-yellowing, moisture resistant, and structurally secure.

The above mentioned objectives of this invention are achieved by the application of an ink receptive matte coating composition, comprising a) one or more hydrophilic, water soluble polymers, b) a hydrophobic cellulose ether polymer, c) a polyalkylene glycol, d) a filler or filler/pigment combination, and e) a solvent system capable of solublizing both the hydrophilic and hydrophobic polymers, provided in an amount sufficient to dissolve both types of polymers, to one or both sides of a thermally stable, non-yellowing transparent, translucent, or opaque base support, such as polyester film, thus forming a matte ink jet recording media for long term storage. Optionally pigments may be added to the composition and media, as may additional hydrophobic polymers.

Matte films formed by the present invention are useful in such ink jet printers and plotters as Hewlett Packard (San Diego, Calif.) DESKJET, PAINTJET and THINKJET series printers for office use and Hewlett Packard's DESIGNJET series plotters for architectural and engineering drawings and graphic design applications.

The present invention provides unexpected features in a matte type ink receiving media. The combination of hydrophilic and hydrophobic polymers in a solvent system capable of dissolving both types of polymers provides a media that is remarkably resistant to moisture and water, thus reducing fingerprinting and stickiness problems and enhancing the longevity of the media and the ink images printed thereon. Another unexpected feature is improved density of the printed image, and superior visible density and U.V. density of the media. These attributes make the media of the present invention particularly suited for prints to be used as masters for subsequent reproduction, and which will be stored for long periods of time. Another feature of the present invention is the lack of curl associated with the media, which improves storability and eliminates the need for additional coatings designed to reduce curling.

DETAILED DESCRIPTION OF THE INVENTION

The present invention encompasses a matte type ink receiving formulation useful for coating onto the surface of a support to form an ink receiving media. The media is particularly useful in ink jet printing applications. The present invention also encompasses a method of making the ink receiving media and a method of using the ink receiving media in ink jet printing applications.

As used herein, the term "approximately" means an amount close to the stated amount that still performs the desired function or achieves the desired result. Generally, the term "approximately, means an amount within 10% of the stated value.

The term "homogeneous" as used herein means a solution wherein the components are evenly mixed, the soluble components being solubilized and the insoluble components being essentially uniformly suspended in the solution. Further, the term "homogeneous" is intended to indicate that the components of the solution do not separate out from one another, or from a gradient when applied to the base support.

The term "archivability" refers to the long term storage of media upon which an ink image is printed. Successful long term storage requires media wherein neither the base support nor the ink receiving coating discolor appreciably over time. Additionally, the printed image should not bleed, deteriorate or decompose. The media must be resistant to moisture and water due to the variety of environmental conditions to which objects stored for extended periods of time are subjected. This attribute further reduces fingerprinting and smudging despite repeated handling. The media additionally should resist curling, tackiness, and sticking to other sheets. Still further, the media should be stable to humidity and temperature.

The ink receiving matte coating composition comprises a) one or more hydrophilic, water soluble polymers, b) a hydrophobic cellulose ether polymer, c) a polyalkylene glycol, d) a filler, and e) a solvent system capable of dissolving both the hydrophilic and hydrophobic polymers, in an amount sufficient to dissolve both types of polymers. Optionally filler/pigment combinations and supplemental hydrophobic polymers may be added.

A desirable ink receiving matte coating composition results when, i) the hydrophilic polymer is a polyvinyl pyrrolidone copolymer;

ii) the hydrophobic polymer is ethylcellulose;

iii) the polyalkylene glycol is polyethylene glycol;

iv) the filler is silica; and v) the solvent is selected from the group consisting of alcohols and glycol ethers.

The Hydrophilic Polymer

The hydrophilic polymer and hydrophobic polymer are binders, which are resinous agents that contribute several important characteristics to the coating composition. The binders provide adhesion to the base support, thicken the coating composition, serve as a carrier for the particulate filler, and among other functions, provide absorptive properties for printability. It is important that these polymers be easily miscible in alcohol and/or glycol ether solvent systems for application as a coating composition.

Importantly, the hydrophilic, water soluble polymer must be soluble in partially hydrophobic and generally non-aqueous solvent systems. Examples of the hydrophilic, water soluble polymers useful in the present invention include those selected from a group consisting of polyvinyl pyrrolidone and its copolymers, polyacrylic acid and its copolymers, polyvinyl acetal, and polyvinyl alcohol.

Desirable hydrophilic, water soluble polymers include polyvinyl pyrrolidone and its copolymers, including: a) polyvinyl pyrrolidone, such as PVP K-90 available from International Specialty Products, Wayne, N.J., polyvinyl pyrrolidone/polyvinyl acetate copolymers, such as PVP/VA I-535 available from International Specialty Products, Wayne, N.J., polyvinyl pyrrolidone/styrene, such as POLECTRON 430 available from International Specialty Products, Wayne, N.J., polyvinyl pyrrolidone/dimethylaminoethylmethacrylate copolymers, such as Copolymer 958 available from International Specialty Products, Wayne, N.J.; b) polyacrylic acid and its copolymers, including polyacrylic acid, such as CARBOPOL 1622 available from B. F. Goodrich, Cleveland, Ohio, and polyvinyl pyrrolidone/polyacrylic acid, such as ACRYLIDONE ACP-1001 available from International Specialty Products, Wayne, N.J.; c) polyvinyl acetal, such as KX-1 available from Sekisui Chemicals, Ltd., Japan; and d) polyvinyl alcohol (such as AIRVOL 205 available from Air Products and Chemicals, Inc., Allentown, Pa. These hydrophilic, water soluble polymers are preferred due to their absorbency of the ink jet printer's ink vehicle. A desirable hydrophilic, water soluble polymer is polyvinylpyrrolidone dimethylaminoethyl-methacrylate (a PVP copolymer), such as COPOLYMER 958 available from International Specialty Products, Wayne, N.J.

The hydrophilic, water soluble polymer of the present invention is generally present in the amount from approximately 5 to approximately 60 percent by weight of the total dried coating. Desirably, the hydrophilic, water soluble polymer is generally present in the amount from approximately 15 percent to approximately 45 percent.

The Hydrophobic Polymer

Examples of the hydrophobic cellulose ether polymer include polymers having an ethoxyl degree of substitution between 2.0 and 3.0. The desired degree of substitution of 2.0 to 3.0 is important because the degree of substitution contributes to the hydrophobicity of the polymer. A particularly desirable hydrophobic cellulose ether polymer is ethylcellulose, such as is available as ETHOCEL STANDARD GRADE, available from Dow Chemical USA, Midland, Mich. Ethylcellulose is a hydrophobic, alcohol soluble resin made from the reaction of alkali cellulose with ethyl chloride. According to the present invention, the amount of hydrophobic cellulose ether present in the dried matte ink receptive coating as a ratio to the amount of hydrophilic, water soluble polymer is from approximately 0.01:1 to approximately 10:1 by weight. Desirably, the ratio of hydrophobic cellulose ether to hydrophilic, water soluble polymer is from approximately 0.1:1 to approximately 1:1 by weight.

Unexpectedly, it was found that the combination of the hydrophilic and hydrophobic polymers resulted in superior edge acuity and image sharpness. Particularly good results where achieved when polyvinylpyrrolidone/dimethylaminoethylmethacrylate and ethylcellulose were combined, as shown in the examples set forth below.

The Polyalkylene Glycol

The polyalkylene glycol acts as a plasticizer to modulate flow, viscosity, leveling and drying characteristics of the coating composition. A surprising and unexpected finding is that the addition of a low molecular weight polyalkylene glycol to the coating composition results in enhanced image density, whereby the monochrome printed image is a denser black and less blue than it would be otherwise on media lacking the polyalkylene glycol. The polyalkylene glycol provides the matte ink receptive coating with excellent flow and wetting characteristics while also acting as a plasticizer for the resinous components. Such effective plasticization improves coating flexibility, thus improving adhesion.

While not wanting to be bound by the following theory, it is thought that the polyalkylene glycol may act as a buffer against pH changes in the applied ink to the matte ink receptive coating, thus permitting improved image density. Alternatively, there may be a synergistic plasticization effect with the resins causing the uniform absorption of the ink's vehicle, thus improving the optical density of the image.

In the present invention, the amount of polyalkylene glycol found in the dried matte ink receptive coating as a ratio to the amount of hydrophilic, water soluble polymer in the coating is from approximately 0.05:1 to approximately 0.5:1 by weight. In a desirable embodiment of the present invention, the amount of polyalkylene glycol to hydrophilic, water soluble polymer is from approximately 0.1:1 to approximately 0.3:1 by weight.

Examples of the polyalkylene glycol include those polyalkylene glycols whose average molecular weight is less than approximately 3,000 and whose melting point is less than approximately 50° C. The polyalkylene glycol may be selected from polyethylene glycols and derivatives thereof, and polypropylene glycol and derivatives thereof. Desirable polyalkylene glycols include polyethylene glycols, particularly polyethylene glycols having a molecular weight of less than approximately 2,000. A particularly desirable polyalkylene glycol is polyethylene glycol (PEG) having a molecular weight of approximately 400 to approximately 600, designated as (PEG 400 and PEG 600, respectively) and available from Aldrich Chemical Co., Inc., Milwaukee, Wis.. A surprising benefit resulting from the addition of low molecular weight polyalkylene glycols, particularly PEG having a molecular weight less than approximately 1000, is unexpected image enhancement wherein the printed image has greater density and is more black and less blue than it would be otherwise.

The Fillers

The fillers are non-soluble particulate matter that provides surface texture to the dried coating, impart color to the coating, and provide a substantial means of ink adsorption due to their porous nature. The filler must have a large capacity to adsorb oil in order to reduce drying times. The oil absorption value is particularly important in a matte ink jet recording media due to the direct contact of the ink jet printer's inks with the filler agents. The selection of fillers also dramatically affects the background density of the films, which is an important consideration for reproductive purposes.

Examples of the filler include precipitated silicas and fumed silicas, diatomaceous earth, kaolin, clays, zeolites and the like whose oil absorption is ≧80 g/100 g. Desirable fillers include precipitated silicas and fumed silicas. Examples of precipitated silica include HP 260, available from Crosfield Company, Ill., and SYLOID 74, available from W. R. Grace & Co. Davison Chemical Division, Md. An example of fumed silica is AEROSIL 200, available from Degussa, Teterboro, N.J. This filler combination was found to yield an optimum balance between hardness and porosity and provided excellent oil adsorption characteristics contributing to improved image sharpness. Furthermore, this combination resulted in surprisingly good visible and U.V. densities, making the resulting film desirable for reprographic applications.

Additionally, the average particle size of the filler is important because large particles generally will cause a very roughened and non-uniform surface appearance. Smaller particles generally have higher bulk densities and require high loading to produce the desired matte surface to the coated coating. Therefore, the fillers should have a particle size of at least 0.1 microns and a maximum of 25 microns. It may be necessary to use a grinding method, such as a ball mill, sand mill, high speed disperser, or the like, to reduce the particle size of the filler and to provide a uniform surface profile. Such grinding methods are well known in the art.

The filler amount found in the present invention as a ratio to the hydrophilic, water soluble polymer is generally from approximately 0.5:1 to approximately 5:1 by weight. However, desirably, the filler to hydrophilic, water soluble polymer ratio is from approximately 1:1 to approximately 2:1 by weight.

Examples of the optional filler/pigment include any of the above recited fillers in combination with a pigment in an amount less than approximately 10% of the total filler weight, such as titanium dioxide, calcium carbonate, zinc oxide, calcined clays, talc, and the like. Desirably, the amount of pigment should be less than 5% of the total filler weight. Pigments may be used in conjunction with the filler to add contrast between the coated matte ink receptive coating and the printed image. Choice of filler or filler/pigment mixtures is limited by the optical and ultraviolet densities of the matte ink receptive coating. One use of the present invention is as a master image to be used in reprographic processes, such as diazo reproduction and electrophotographic processes. High optical density may be desired to promote contrast between the matte ink receptive coating and the printed image. However, an increase in optical density is generally associated with an increase in ultraviolet density. High ultraviolet density of a matte type ink jet recording media necessitates slower diazo reproduction rates, which is considered a disadvantage in the art. Optical density refers to the brightness of the matte ink receptive coating. Therefore, a critical balance of both densities is necessary.

The Solvent System

Solvents useful in the present invention generally are non-aqueous, (although water can be present), are capable of solubilizing the hydrophilic and the hydrophobic polymers, and are provided in an amount sufficient to completely dissolve the hydrophilic and the hydrophobic polymers. Generally, the solvents are selected from the group consisting of alcohols and glycol ethers. The solvent system also affects coating characteristics such as flow, viscosity, and leveling characteristics and drying time of the coating composition.

In order to provide a matte ink receptive coating that is useful for long term storage of master plots, it is also important that the coated coating be as resistive to moisture as possible. Consequently, organic solvent systems, such as alcohols or glycol ethers, or organic solvent/aqueous mixtures are used in the ink receiving matte coating composition. The solvent system used must be carefully chosen to provide proper evaporation rates after the coating is applied to the base support so as not to cause surface defects such as craters and pinholes. Solvents useful in the present invention are also selected for their ability to solubilize all of the non-filler/pigment components of the ink receiving matte coating composition.

The solvents do not contribute to the solid mass of the dried coating composition. Solvents may be selected from alcohols such as ethanol, isopropanol, butanol, and glycol ethers such as propylene glycol monomethyl ether, ethylene glycol monoethyl ether, ethylene glycol monopropyl ether, and the like. A desirable solvent system comprises a combination of isopropyl alcohol, propylene glycol monomethyl ether (marketed as GLYCOL ETHER PM) and ethylene glycol monopropyl ether (marketed as GLYCOL ETHER EP), all available from Ashland Chemical, Inc., Columbus, Ohio, that is capable of dissolving all of the non-filler/pigment components of the ink receiving matte coating composition.

An advantage of using such solvent systems is that supplemental hydrophobic polymers can be included in the coating composition to further enhance water resistance. The ink receiving media of the present invention exhibits resistance to moisture in large part due to the hydrophobicity of the cellulose ether polymer. The moisture and water resistance of the present invention may be further improved, however, by addition of an optional hydrophobic, water insoluble, polymer that is compatible with the components of the present invention. Water resistance is meant as the resistance of the dried matte ink receptive coating to removal from the base support by contamination with water. Water resistance may be tested by rubbing the matte ink receptive coating with a dampened cloth, by exposure of the coated layer to running water, or by immersion of the whole recording media in water. Such optional hydrophobic, water insoluble polymers include, but are not limited to, polyvinylbutyral, polyvinyl formal, polyketone resins, acrylic resins, and the like. A desirable optional hydrophobic, water insoluble polymer is polyvinyl butyral, such as S-LEC BL-3, available from Sekisui Chemical Co. Ltd., Japan, which is miscible in desired alcohol and/or glycol ether solvent systems for the coating composition. Such optional hydrophobic polymers are provided in a range of approximately 0.1:1.0 to approximately 10.0:1.0 by weight of hydrophilic polymer. When the supplemental hydrophobic polymer is polyvinyl butyral, a suitable amount whose dry weight is approximately equal to the dry weight of the hydrophilic polymer.

Water resistance is an important property for the archivability of the recording media. Further, increased resistance to moisture contact generally means less effect of humidity on the drying time of the printed image. Drying time is meant to be the amount of time that it takes a predetermined image area or symbol to dry to the touch starting from the moment that image or symbol was formed on the surface of the printing substrate. Due to the porous nature of matte type ink jet recording media, atmospheric moisture may settle, or be absorbed by hydrophilic polymers, thus increasing the amount of time taken for the ink to be absorbed and/or the ink's vehicle to be evaporated.

The ink receiving matte coating composition of the present invention can be made by dissolving the hydrophilic, water soluble polymer and the hydrophobic cellulose ether resin in suitable solvents to form a solution. Limited amounts of water can be used to solvate this resin system, but generally no more than 50% of the total solvent content. Non-soluble components such as filler and pigments are also thoroughly blended into the solution to form a homogeneous mixture. Homogeneous mixtures may be made to various non-volatile contents, and the dry thickness calculated based on the solution application thickness and the non-volatile content.

The ink receiving media comprises a base support having coated on one or both sides thereof the above described ink receptive matte coating composition. The base support for the present invention may be any suitable transparent, translucent, or opaque polymeric film, such as polyethylene terephthalate, cellulose acetate, polysulfone, polycarbonate, polyolefin, or other polymeric film base support. The base support may optionally contain a pretreatment to its surface to promote such properties as adhesion between the applied coating and base or an anti-static agent to dissipate electrostatic buildup, or the base may be supplied without any pretreatment coating. Polyester base supports as described are readily available from manufacturers and include MELINEX film (supplied by Imperial Chemicals, Inc. Hopewell, Va.), HOSTAPHAN film (supplied by Hoechst Diafoil, Greer, S.C.), and MYLAR film (supplied by E. I. Du Pont de Nemours & Company, Wilmington, Del.).

Suitable base supports of the present invention are the polyethylene terephthalate films because of their inherent physical and environmental stability and its abundant supply. Desirable base supports include HOSTAPHAN #3507 adhesion promoting base support, and MELINEX 505 adhesion pretreated polyester base support film. The thickness of the base support may range from approximately 25 to approximately 200 microns.

In one embodiment of the present invention, the coating of a matte ink receptive coating may be applied to one or both sides of the base support forming an opaque layer, or layers, that act to receive the ink provided by an ink jet printing device.

In another embodiment of the present invention, the coating of a matte ink receptive coating may be applied to one side of the base support while to the opposite side of the base support, a separate non ink-receptive, tracking layer may optionally be applied to assist the feeding of the film through an ink jet printing device. Tracking layers are well known in the art and generally consist of a binder to which a small amount of filler is added to provide a roughened surface profile. The toughened surface promotes traction of the recording material as it is fed through the ink jet printing device by a motor driven feed roll. Any resinous material known in the art to adhere to the base support, such as polyester, polyvinyl butyral, two component urethanes, acrylic resins, such as ACRYLOID B-66 (Rohm-Haas, Philadeliphia, Pa.), polyvinylidene chloride resins, such as SARAN F 310 (Dow Chemical, Midland, Mich.) and the like, may be used with fillers to provide the desired surface effect.

In yet another embodiment of the present invention, a coating of adhesion promoting primer is applied as a first coating to the base support, which first coating is subsequently coated on its surface with the matte ink jet receptive layer to promote the adhesion between the matte ink receptive layer and the base support. This option is available for one or both sides of the base support. In the event of one side coating of the primer and the matte ink receptive coating, the opposite side of the base support may optionally be coated with a tracking layer to assist the feeding of the film through the ink jet printing device. Primers as described in this embodiment of the present invention provide adhesion between the base support and matte ink receptive coating as described. Generally, solutions of binders known in the art to adhere to the base support, such as those described above for a tracking layer, may be applicable.

The present invention further encompasses a method of making the ink receiving media of the present invention wherein the ink receiving matte coating composition is coated onto a base support. Many methods for applying such a coating to a base support are known in the art, and all such methods are intended to be encompassed within the scope of the appended claims. Application of the homogeneous mixture of the ink receiving matte coating composition to the base support can be performed by any number of known coating methods, such as dip coating with a doctor blade, wire wound Mayer bar coating, reverse roll coating, and the like. Generally, the coating solution is applied to the base support and metered to a desired wet thickness. Then, the solution containing base support can be dried by some conventional method, such as forced air ovens, to create the desired dried coating on the base support. A desirable method of producing the ink receiving media of the present invention is wire wound Mayer bar coating followed by oven and air drying.

The thickness of the dried matte ink receptive coating generally is from approximately 5 to approximately 100 microns. It should be noted that the thickness of the matte coating directly affects the ultraviolet and optical densities. Also, the thickness of the coating of the present invention may affect the absorption rate and quality of the printed image. For example, at a higher thickness such as 75 microns, the ink applied to the matte ink receptive coating may be absorbed directly into the coating, leaving only a small amount of dye on the surface of the coating which will result in lower image density, i.e. poor image appearance. However, in such a case, the drying time of the image will be shorter due to the increased absorption. A balance of fast drying time, high quality images, and good ultraviolet and optical densities can be achieved by the present invention. Desirably, the present invention should be coated to a dry thickness of approximately 10 microns to approximately 50 microns. A desirable dry coating thickness is approximately 25 microns.

The present invention also encompasses a method of using the ink receiving media of the present invention in printing applications. The matte type ink jet recording media of the present invention can be used in an ink jet printing process as a substrate for image development. Also, ink receiving media of the present invention may be used with other printing or copying processes, such as pen plotters, hand writing with ink pens, and plain paper copying. The present invention, when used as a printing substrate media in ink jet printing processes, not only provides fast drying time of the ink, but formation of precise images and symbols, without spreading. Thus, smearing of the printed ink is avoided and sharp, precise images are formed without the use of surface active agents, mordants, or ionic dye fixatives as taught in the prior art.

Another advantageous feature of the present invention is the lack of curling of the ink receiving media. This allows media to be produced without the expense and time required to apply additional coatings to combat curling. Such an anticurl feature is especially advantageous for media used in reprographic and archival applications. It is believed that the polymers used in the present invention do not undergo appreciable change in physical size as a function of temperature. Thus, curling, which generally results from shrinkage of polymers adhered to a base support, is reduced or eliminated in the present invention.

By referring to the following, a more detailed view of the present invention is illustrated. The present invention should not be limited by these example formulations and comparative data.

EXAMPLE I

A 15% non-volatile coating solution was prepared using the following recipe and methods, where the parts per weight of the ingredients were measured in grams:

| Ingedients | Parts per weight |
|---|---|
| PVP K-90 polyvinyl pyrrolidone | 10.0 |
| Polyethylene glycol | 0.25 |
| SYLOID 74 silica | 4.0 |
| GASIL 200DF silica | 0.75 |
| Isopropanol | 40.0 |
| GLYCOL ETHER PM | 45.0 |

The above solution was mixed using a high speed disperser for 30 minutes to dissolve the PVP K-90 resin and to grind the silica particles to create a more uniform surface. 30 grams of this solution was then measured into two separate beakers. One beaker of this solution, designated Sample A, was unchanged. To a second beaker of the above mixed solution, designated Sample B, 1.5 grams (or 50% of the total weight of the hydrophilic, water soluble polymer) of ethylcellulose was added and dissolved.

Each solution was then coated onto 8.5"×11" MELINEX 505 adhesion pretreated polyester base support film using a wire wound Mayer bar to set the wet thickness by the drawdown method. The resulting coated films were then dried in a convection oven for 3 minutes at 120° C. and removed to room temperature for cooling, with the resulting dry thickness measured at 25 microns using a digital, inductive gauge head thickness meter (such as is produced by Feinpruf GmbH under the tradename MILLITRON, and available from Tool and Gage House, Charlotte, N.C.). Using the test pattern of a Hewlett Packard. DESKJET 500C with monochrome ink supply, the coated film samples were examined for use as a recording media.

Results of the printing exam for Sample A revealed that while the drying of the ink was less than 90 seconds at 70% relative humidity, the lateral diffusion of the ink caused the images to become blurred. Lateral diffusion of the ink was measured at up to 0.5 mm using a hand held microscope with metric scale for a standard test pattern image. Sample B was tested in the same printing device, but the edge acuity was markedly improved and exhibited 0.00 mm lateral diffusion of the inked image. Drying time for Sample B was also less than 90 seconds.

EXAMPLE II

A 20% non-volatile coating solution was prepared using the following recipe, where the parts per weight of the ingredients were measured in grams:

| Ingredients | Parts Per Weight |
|---|---|
| Copolymer 958 (50% non-volatile) | 20.0 |
| S-LEC BL-3 Polyvinylbutyral | 2.5 |
| Ethylcellulose | 0.5 |
| GASIL HP260 silica | 5.5 |
| $CaCO_3$ | 0.5 |
| Polyethylene glycol 600 | 1.0 |
| Isopropanol | 30.0 |
| GLYCOL ETHER PM | 50.0 |

The solution was mixed using a high speed disperser for 30 minutes to dissolve the resinous components while grinding the filler to provide a more uniform surface appearance. The solution was then coated onto a three separate 8.5"×11" sheets of HOSTAPHAN #3507 adhesion promoting base support using a wire wound Mayer bar using the drawdown method. The resulting coated film samples were individually dried at 120° C. for 3 minutes in a convection oven and removed to air cool at room temperature. The total dry thickness of the coated samples was measured again at 25 microns.

Using the Hewlett Packard DESKJET 500C office printer with monochrome ink, one sample of the above coated film was examined for printing performance and use as a matte type ink jet recording film. The resulting drying time of the film sample was less than 90 seconds at 70% relative humidity for a 3 mm square symbol in the printed test pattern. The printed image had superior image sharpness and edge acuity and exhibited no lateral diffusion. Another sample of the above coated film was then examined using the Hewlett Packard DESIGNJET 650C plotter's monochrome test pattern palette. The test palette was fully dried to the touch in under 2 minutes at 70% relative humidity. Edge sharpness was once again excellent and no spreading of the ink occurred. Optical density measurements of the darkest inked symbols were measured using a X-Rite model 369 densitometer, which measures transmissive density with either an ultraviolet or visible filter. Visible density measurements were consistently above 1.40 and ultraviolet measurements for these symbols consistently above 1.60. The results of the density measurements are indicative of the contrast of the inked image to the matte ink jet recording film, whose visible and ultraviolet densities were consistently above 0.10 and 0.15, respectively.

Also, to test archivability of the coated recording material, 5 square centimeter squares of the previously printed matte ink jet recording material coated above were placed into separate glass beakers filled with water and totally immersed in deionized water for 48 hours. The water immersion test of the printed image was designed to examine if the ink of the image would resolve and bleed from the imaged symbols. Also, the immersion test would examine if the applied matte ink receptive coating would be solubilized, or easily removed from the base. Both samples were measured for visible and ultraviolet densities of its imaged areas before and after immersion in the water. Densities indicate that the inked areas did not reduce in density, but actually slightly increased in their respective densities, probably due to slight spreading of the ink. Thickness measurements after the immersion indicated that the total coating thickness did not change, therefore indicating that the coating had not been solubilized by the water.

Lastly, the third sample of the above described recording media was printed using a Hewlett Packard DESIGNJET 650C with full color (yellow, cyan, & magenta) cartridges to examine the printability of the media for color images. Using the color test pattern palette, the inks were dried in less than three minutes with no lateral diffusion.

EXAMPLE III

Another ink receiving matte coating composition and ink receiving media (18% solid solution) was prepared according to the method described above in Example II wherein the following components and parameters were used. The parts per weight of the ingredients were measured in grams:

| Ingredients | Parts Per Weight |
|---|---|
| Copolymer 958 (50% non-volatile) | 15.0 |
| S-LEC BL-3 Polyvinylbutyral | 7.5 |
| Ethylcellulose | 1.9 |
| GASIL HP260 silica | 9.4 |
| SYLOID 74 silica | 4.0 |
| Polyethylene glycol 600 | 3.8 |
| Isopropanol | 40.0 |
| GLYCOL ETHER PM | 94.9 |
| GLYCOL ETHER EP | 47.4 |

EXAMPLE IV

A 10% solution of a primer was prepared for use as an adhesion promoter using the following ingredients:

| Ingedients | Parts per Weight |
|---|---|
| ACRYLOID B-66 acrylic resin | 7.5 |
| SARAN F-310 polyvinylidene chloride | 2.5 |

-continued

| Ingedients | Parts per Weight |
|---|---|
| Methylethyl ketone | 45.0 |
| Toluene | 45.0 |

The solution was prepared by dissolving the resinous components in the solvents using a magnetic stirrer. The solution was then coated onto an 8.5"×11" sheet of Imperial Chemistry, Inc. #339 adhesion pretreated white opaque polyester base support using a wire wound Mayer bar to a wet thickness of approximately 25 microns. After drying the coating in a convection oven for 1 minute at 90° C, the "primed" sheet was removed and cooled at room temperature. A overcoating of matte ink receptive coating, of the same formula as Example II, was applied on the "primed" surface using the above described method of drawdown coating with a Mayer bar.

The resulting matte ink jet recording media was then tested for archivability and physical stress properties. Adhesion of the base support to the primer and the primer to the matte ink receptive coating is measured using a cross-cut adhesion tape adhesion test. This test involves cutting through the coated layers to the surface of the base support using a suitable device, such as a knife or razor blade. A checkerboard pattern of eleven parallel cuts, about 1 mm apart, in one direction and eleven parallel cuts, also 1 mm apart, in the perpendicular direction to the first cuts will reveal a checkerboard pattern of 100 squares approximately 1 mm on each side. An adhesive tape is then placed by hand firmly over the cross-cut pattern and quickly removed in an upward motion from the film. Adhesion of the coated layer may be reported as the percent, or number, of "squares" of the coating removed. For example, the above described coating of the present invention using a "primed" base support as described yielding a cross-cut tape adhesion of 0%, meaning that no "squares" were removed. Adhesion of the coated layers to the substrate is imperative for long term storage of recording media. Also, a portion of this sample was placed under glass in sunlight for a period of six months to test for any yellowing that may occur due to ultraviolet degradation of the coating components or base support. There was no noticeable visual difference between the exposed portion of the present invention and the unexposed portion after the six month period.

I claim:

1. A ink receiving medium comprising, a) a polymeric film base support; and b) an opaque ink receiving layer coated onto at least one side of the base support, the ink receiving layer comprising:

(i) a hydrophilic, water soluble polymer selected from the group consisting of polyvinyl pyrrolidone and copolymers thereof, polyacrylic acid and copolymers thereof, polyvinyl acetal, and polyvinyl alcohol;

(ii) ethylcellulose with an ethoxyl degree of substitution between 2.0 and 3.0;

(iii) a polyalkylene glycol having an average molecular weight of less than approximately 3,000 and a melting point of less than approximately 50° C.; and (iv) a filler whose oil adsorption is greater than approximately 80 g oil/100 g filler and whose average particle size is between approximately 0.1 microns and approximately 25 microns, wherein the filler is selected from materials consisting of precipitated silicas, fumed silicas, diatomaceous earth, kaolin, clays, and zeolites.

2. The medium of claim 1 wherein (i) the hydrophilic polymer is a polyvinyl pyrrolidone copolymer;

(ii) the polyalkylene glycol is polyethylene glycol;

(iii) the filler is silica; and (iv) the base support is selected from the group consisting of polyethylene terephthalate, cellulose acetate, polysulfone, polycarbonate, and polyolefin.

3. The medium of claim 1 wherein the hydrophilic, water soluble polymer is provided in an amount from approximately 5 percent to approximately 60 percent by weight of the total dried coating weight, the ethylcellulose is provided as a ratio to the amount of hydrophilic, water soluble polymer from approximately 0.01:1 to approximately 10:1 by weight, the polyalkylene glycol is provided as a ratio to the amount of hydrophilic, water soluble polymer from approximately 0.05:1 to approximately 0.5:1 by weight, the filler is provided as a ratio to the hydrophilic, water soluble polymer from approximately 0.5:1 to approximately 5:1 by weight.

4. The medium of claim 1 wherein the hydrophilic, water soluble polymer is provided in an amount from approximately 15 percent to approximately 45 percent by weight of the total dried coating weight, the ethylcellulose is provided as a ratio to the amount of hydrophilic, water soluble polymer from approximately 0.01:1 to approximately 1:1 by weight, the polyalkylene glycol is provided as a ratio to the amount of hydrophilic, water soluble polymer from approximately 0.1:1 to approximately 0.3:1 by weight, the filler is provided as a ratio to the hydrophilic, water soluble polymer from approximately 1:1 to approximately 2:1 by weight.

5. The medium of claim 1 wherein, i) the hydrophilic polymer is polyvinylpyrrolidone/dimethylaminoethylmethacrylate;

ii) the polyalkylene glycol is polyethylene glycol; and iii) the filler is a precipitated silica.

6. The medium of claim 5 wherein, i) the hydrophilic polymer is provided as approximately 1 part by dry weight;

ii) the ethylcellulose is provided as approximately 0.25 parts by dry weight;

iii) the polyalkylene glycol is provided as approximately 0.50 parts by dry weight; and iv) the silica is provided as approximately 1.8 parts by dry weight.

7. The medium of claim 1 further comprising a hydrophobic polymer selected from the group consisting of polyvinylbutyral, polyvinyl formal, polyketone resins, and acrylic resins.

8. The medium of claim 1 further comprising a pigment selected from the group consisting of titanium dioxide, calcium carbonate, zinc oxide, calcined clays, and talc.

* * * * *